US005128687A

United States Patent [19]

Fay

[11] Patent Number: 5,128,687

[45] Date of Patent: Jul. 7, 1992

[54] SHARED APERTURE ANTENNA FOR INDEPENDENTLY STEERED, MULTIPLE SIMULTANEOUS BEAMS

[75] Inventor: Francis A. Fay, Sudbury, Mass.

[73] Assignee: The Mitre Corporation, Bedford, Mass.

[21] Appl. No.: 521,221

[22] Filed: May 9, 1990

[51] Int. Cl.[5] ..... H01Q 19/060; H01Q 15/040; H01Q 3/240

[52] U.S. Cl. ..... 343/754; 342/376

[58] Field of Search ..... 343/753, 754, 853; 342/376, 368-375; 333/137, 125, 136

[56] References Cited

U.S. PATENT DOCUMENTS

| | | | |
|---|---|---|---|
| 3,761,936 | 9/1973 | Archer et al. | 343/754 |
| 4,032,922 | 6/1977 | Provencher | 343/854 |
| 4,086,597 | 4/1978 | Sinsky et al. | 343/754 |
| 4,268,831 | 5/1981 | Valentino et al. | 343/754 |
| 4,348,678 | 9/1982 | Thomas | 343/754 |
| 4,408,205 | 10/1983 | Hockham | 343/16 R |
| 4,490,723 | 12/1985 | Hardie et al. | 343/754 |
| 4,523,198 | 6/1985 | Clapp | 343/754 |
| 4,580,140 | 4/1986 | Cheston | 343/754 |
| 4,595,926 | 6/1986 | Kobus et al. | 343/754 |
| 4,599,584 | 8/1986 | Sasser et al. | 333/125 |
| 4,641,144 | 2/1987 | Prickett | 343/754 |
| 4,689,627 | 8/1987 | Lee et al. | 343/853 |
| 4,721,960 | 1/1988 | Lait | 342/368 |
| 4,825,216 | 4/1989 | DuFort | 343/754 |
| 4,845,507 | 7/1989 | Archer et al. | 343/754 |

OTHER PUBLICATIONS

D. H. Archer, Lens-Fed Multiple Beam Arrays, Microwave Journal, pp. 171-195 (Sep. 1984).

Jesse Butler et al., "Beam-Forming Matrix Simplfies Design of Electronically Scanned Antennas", Electronic Design, Apr. 12, 1961, pp. 170-173.

Judd Blass, "Multidirectional Antenna A New Approach to Stacked Beams", 1960 I.R.E. Convention Record, Pt. 1, p. 48-50.

John Ruze, "Wide-Angle Metal-Plate Optics", vol. 1 Proceedings of the I.R.E. vol. 38, pp. 53-59, (Jan. 1950).

W. Rotman, "Wide-Angle Microwave Lens for Line Source Applications", vol. AP-11, No. 6, (Nov. 1963).

*Primary Examiner*—Michael C. Wimer
*Assistant Examiner*—Peter Toby Brown
*Attorney, Agent, or Firm*—Fish & Richardson

[57] ABSTRACT

An antenna including a lens that has an array of radiating elements located on a focal arc, each radiating element corresponding to a different transmission beam direction; and a beam launcher having a plurality of phased arrays and a plurality of internal probes, each of the plurality of internal probes being electrically coupled to a corresponding one of the radiating elements, the phased arrays for space feeding a selected one or more of the radiating elements with signals so as to generate corresponding transmission beams from the lens.

37 Claims, 5 Drawing Sheets

SHARED APERTURE ANTENNA FOR INDEPENDENTLY STEERED, MULTIPLE SIMULTANEOUS BEAMS

BACKGROUND OF THE INVENTION

The invention relates to antennas capable of generating multiple beams through a common aperture.

Radar, communication and electronic warfare systems must often be capable of both transmitting high power signals and receiving low power signals. Another desirable feature is the capability of simultaneously transmitting signals to or receiving signals from a number of geographically separate locations. For example, radar must often provide multiple operating modes, such as search and track, where each mode has different waveform parameters and antenna steering requirements. Communication systems must often maintain links with two or more nodes that are not along the same line of sight. And, electronic warfare systems must often receive and resolve signals over a wide angular field of view while simultaneously transmitting with several narrow beams having different, unrelated directions.

These capabilities can be achieved through the use of multiple independently steerable antenna apertures. Or, if a shared aperture is more desirable, certain beam forming networks may be used. There are two major types of beam forming networks, namely, matrices and lenses.

One example of a matrix network is the Butler matrix, described by J. Butler and R. Lowe in "Beam Forming Matrix Simplifies Design of Electronically Scanned Antenna", Electronic Design, Vol. 9, No. 8, pp. 170–73 (Apr. 12, 1961). The Butler matrix is a linear, bilateral device with the properties of superposition and reciprocity. It has $2^N$ input ports and $2^N$ output ports. Typically, each output port is connected to a corresponding element of a linear array of radiating elements. Driving only one input port with a source of electromagnetic energy produces a single beam that has a direction corresponding to the input port that was selected. Driving multiple ports results in multiple beams each having a direction corresponding to the input port that was driven. If all of the input ports are driven, a cluster of $2^N$ beams results. The cluster of beams may be scanned in space if beam steering elements, such as phase shifters or time delay networks, are placed between every output port of the matrix and its corresponding radiating element. However, the beam steering elements do not permit any single beam to be steered independently of any other beam.

In the Butler matrix, signal parameters, such as center frequency, total bandwidth and modulation, can differ from one input port to another. Thus, different signals can be launched in different directions as long as the beams are orthogonal. Furthermore, when the Butler matrix is operated in a receive only mode, the port from which energy emerges identifies the direction from which the energy was received.

Switching beam directions is accomplished by switching input ports. When the number of simultaneous beams is large and/or when a high power level is being used (as is common in radar, communications and electronic warfare systems) switching input ports can become complicated.

Another matrix beam forming network is the Blass matrix as described by J. Blass in "The Multidirectional Antenna: A New Approach to Stacked Beams", 1960 I.R.E. Convention Record, Pt. 1, pp. 48–50. It differs from the Butler matrix in that neither the input nor output ports are constrained to the quantity $2^N$ and the number of input and output ports need not be equal. In addition, the beams need not be orthogonal. The Blass matrix forms a cluster of beams that can be rapidly steered electronically, in the same manner as for the Butler matrix, but none of the beams can be steered independently without dynamically revising the design of the matrix.

Lens beam forming networks share the same basic properties of matrices, namely, they are linear, bilateral devices with the properties of superposition and reciprocity. Lens beam forming networks are a class of antenna that is similar to an optical lens, i.e. the microwave lens converts a point source of electromagnetic energy into a linear phase front.

The Ruze lens, as described by John Ruze in "Wide-Angle Metal-Plate Optics", Proceedings of the I.R.E., Vol. 38, No. 1, Jan. 1950, pages 53–59, is an example of a lens beam forming network. The Ruze lens is a line source antenna that can provide multiple, independently steerable, simultaneous beams. Like other microwave lenses, it has a focal arc with each position along that arc corresponding to a different beam direction. Pointing the beam in a particular direction is accomplished by merely placing a beam launching device at the corresponding location on the focal arc of the lens and scanning of the beam is accomplished by moving the beam launcher along the focal arc. Using multiple beam launchers produces multiple simultaneous beams each of which may be steered independently of the other beams. In addition, the aperture of the lens can be large enough to produce the desired far field beamwidth independent of the number of resolvable beam directions that are used.

One type of beam launcher is a waveguide. Each independent beam requires its own length of waveguide. Changing the direction of any of the multiple simultaneous beams produced by the waveguide beam launchers requires the mechanical relocation of the waveguide.

An alternative to the waveguide beam launcher is an array of monopole elements, hereinafter referred to as probes, or radiating elements mounted along the focal arc. Each probe location corresponds to a specific beam direction. When driven by an electromagnetic energy source, a probe will radiate energy in a well defined and predetermined direction. And, since the lens is a reciprocal device, energy received from that direction will come to a focus at that probe.

Beam pointing angles corresponding to locations between two adjacent probes can be achieved by splitting the power from the electromagnetic source between the two adjacent probes and by amplitude and/or phase weighting of the distributed power.

Typically, a complex network of switches directing signals to the probes on the focal arc is used to achieve rapid and random steering of beams. The switch network is nominally the same kind of switch network that would be required to switch between input ports of a Butler matrix or any other matrix beam forming network. As with the matrix beam forming networks, in many applications, the switching network must be capable of handling high power levels.

The Ruze lens is only one of many lens antennas wherein the beam direction corresponds to a location on the focal arc. Other examples of lenses include, but are not limited to, the Rotman lens as described by W. Rotman and R. F. Turner in "Wide-Angle Microwave Lens for Line Source applications", IEEE Transactions on Antennas and Propagation, Vol. AP-16, No. 6, Nov. 1963, pages 623–632; the Luneburg lens as described on pages 189 through 213 in "Mathematical Theory of Optics," published by Brown University in 1944; and other lenses such as the R-2R and R-KR lenses described by D. H. Archer in "Lens-Fed Multiple Beam Arrays", Microwave Journal, Sep. 1984, pages 171–195.

SUMMARY OF THE INVENTION

In general, in one aspect, the invention features an antenna including a lens having an array of radiating elements located on a focal arc, each radiating element corresponding to a different transmission beam direction; and a beam launcher including a phased array and a plurality of internal probes, each of the plurality of internal probes being electrically coupled to a corresponding one of the radiating elements, the phased array for space feeding a selected one or more of the radiating elements with a signal so as to generate a corresponding transmission beam from the lens.

In preferred embodiments, the lens includes means for limiting orthogonal dispersion of the transmit beam. In particular, the dispersion limiting means are two parallel metal plates arranged so that the array of radiating elements is located between said metal plates. Also, the lens is either a Ruze lens or a Rotman lens and the focal arc is a circular arc.

Also in preferred embodiments, the phased array is a focused phased array including a plurality of phased array radiating probes and the internal probes are arrayed along a curve having a radius R. The beam launcher further includes two parallel metal plates between which are the focused array radiating elements and the array of internal probes are disposed. The antenna also includes a receiver circuit for receiving received signals from at least some of the lens radiating elements and the receiver circuit includes a receiver horn. In one embodiment, the receiver horn is a flared waveguide having a narrow end and a large end opposed to the narrow end and it includes an array of internal probes located at the wide end and a receive probe located at the narrow end. The array of internal probes in the horn is arrayed along a curve having a radius R. In another embodiment, the receiver circuit includes a signal bus and a matrix of switches for electrically coupling selected elements of the array of lens radiating elements to the signal bus. The antenna also includes a plurality of circulators for directing transmission energy from the beam launcher to the lens and for directing received energy from the lens to the receiver circuit.

In other preferred embodiments, the beam launcher includes a plurality of phased arrays (which includes the first mentioned phased array). Each of the phased arrays of the plurality of phased arrays is for space feeding a selected one or more of the radiating elements with a different transmit signal so as to generate a plurality of independently steerable transmission beams from the lens.

One advantage of the invention is that it is capable of producing multiple, independently steerable, simultaneous beams through a common aperture. In addition, the invention is capable of handling high power levels typically associated with many radar, communications and electronic warfare applications and it is capable of changing beam directions rapidly. Furthermore, the invention can be used in connection with a wide range of lenses including, for example, Ruze lenses, Rotman lenses, R-2R lenses, R-KR lenses, cylindrical Lunenburg lenses and Geodesic lenses.

Other advantages and features will become apparent from the following description of the preferred embodiment and from the claims.

DESCRIPTION OF THE PREFERRED EMBODIMENTS

STRUCTURE AND OPERATION

Figure 1:
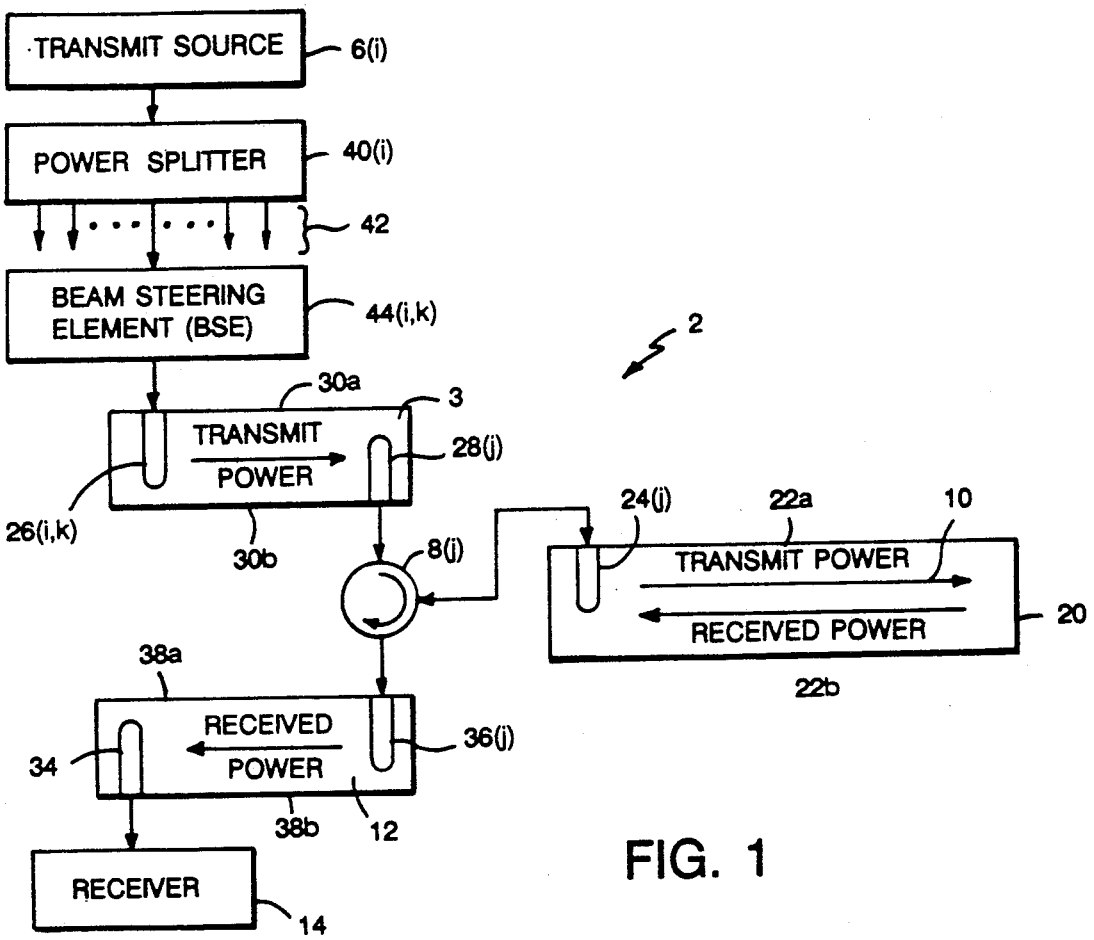
FIG. 1 is a block diagram of a shared aperture antenna system.
Figure 2:
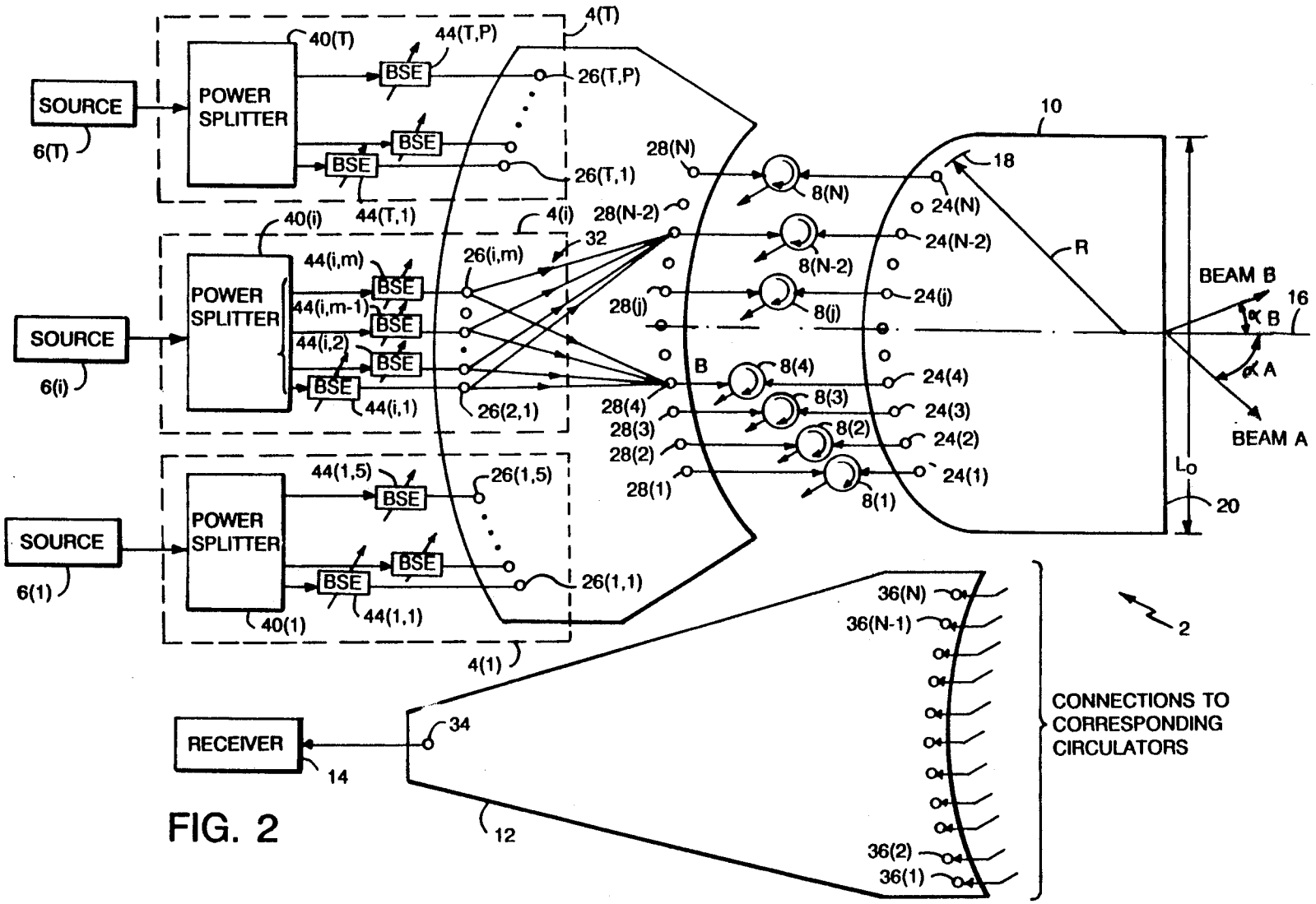
FIG. 2 is a more detailed illustration of the beam launcher, the Ruze lens and the receive horn shown in FIG. 1.

Referring to FIGS. 1 and 2, in a shared aperture transmit/receive antenna 2, a beam launcher 3 feeds transmit power from transmit sources 6(1) to 6(T) to circulators 8(1) to 8(N) (generally referred to as circulators 8), which, in turn, feed the transmit power to a Ruze lens 10. Received power from Ruze lens 10 is also directed by circulators 8 to a receive horn 12, which collects the received power and sends it to a receiver 14. Ruze lens 10 is symmetric about a center line 16 and includes at one end a circular contour 18 of radius R, also known as the focal arc, and at the other end an antenna output aperture 20 which acts as a straight front line source of length $L_o$. Ruze lens 10 also includes two metal plates **22*a* and 22*b* forming a top and bottom, respectively, of lens 10. Between metal plates 22*a* and 22*b* and located near focal arc 18 is an array of focal arc radiating elements 24(1) through 24(N) (referred to collectively as focal arc radiating elements 24) that are arranged in a curve having a radius R. Feeding microwave power to a particular one of focal arc radiating elements 24(j) generates a transmit beam having a corresponding angle $\alpha_j$ relative to center line 16**.

The far field beamwidth of Ruze lens 10 is determined by the length, Lo, of the line source, the wavelength, $\lambda$, of the transmit signal and the boresight of the beam, $\alpha$, relative to center line 16. The far field beamwidth equals $\lambda/(L_o \cos \alpha)$.

Beam launcher 3, which selects the particular focal arc radiating element 24(j) or group of radiating elements 24 of Ruze lens 10 that are to receive microwave power, also includes focused phased array antennas 4(1) to 4(T) (referred to collectively as phased arrays 4) and an array of internal probes 28(1) to 28(N) (referred to collectively as internal probes 28). Internal probes 28 are equal in number to focal arc radiating elements 24 in Ruze lens 10 and are arranged along a curve also of radius R.

Each of phased arrays 4 is a similarly constructed, separate beam generating device. Using phased array 4(i) as an example, it includes a power splitter 40(i), beam steering elements (BSE's) 44(i,l) to 44(i,M) (referred to collectively as BSE's 44(i)) and an array of radiating elements 26(i,l) to 26(i,M) (referred to collectively as radiating elements 26(i)). Of course, the number of radiating elements in each of the antennas 26(1) to 26(T) need not be the same. Phased array 4(i) generates a launch beam 32 that focuses transmitted energy onto a particular one or more of internal probes 28, i.e., it brings the transmitted energy into phase at a point in its near field corresponding to the location of the particular one of internal probes 28 to which energy is to be transferred. Radiating elements 26(i) and internal probes 28 are located on a plane that lies between two parallel metal plates 30*a* and 30*b*. Metal plates 30*a* and 30*b* aid in focusing power from phased arrays 4 onto the desired set of internal probes 28 by limiting the dispersion of the launch beam in directions orthogonal to the plane of internal probes 28. Each of internal probes 28 is connected to a corresponding one of focal arc radiating elements 24 of Ruze lens 10 through a corresponding circulator 8. The signal paths between internal probes 28 and corresponding focal arc radiating elements 24 have equal lengths so that they introduce no relative time delays or phase shifts in the transmit signal.

Receive horn 12 consists of the flared extension of a length of waveguide having a single receive probe 34 located at the narrow end and an array of internal probes 36(1) to 36(N) (referred to collectively as internal probes 36) located at the flared end. Internal probes 36 are equal in number to radiating elements 24 in Ruze lens 10 and are arrayed along a curve that also has a radius R. Receive element 34 and internal probes 36 are located on a plane that lies between two parallel metal plates 38*a* and 38*b*. Energy received by any internal probe 36 at the flared end of horn 12 is collected by single receive probe 34 at the narrow end of horn 12 and transferred to receiver 14. As with the electrical signal paths between beam launcher 3 and Ruze lens 10, the signal paths between radiating elements 24 and corresponding internal probes 36 of receive horn 12 also have equal lengths so that they introduce no relative phase delays in the received signals.

Transmit source 6(i) generates a transmit signal having power P. Power splitter 40(i) divides the transmit signal into M signals 42, each having power P/M. Each of the M signals 42 is sent to a corresponding one of BSE's 44(i) which uses either a variable phase shifter or a variable time delay network to produce a drive signal for a corresponding one of radiating elements 26(i) of phased array 4(i). The set of BSE's 44(i) introduces appropriate relative phase shifts or time delays into the transmit signals so that phased array 4(i) generates a focused launch beam 32 that transfers transmit power to the desired probe in the set of probes 28. Since each of probes 28 is electrically coupled to a corresponding one of radiating elements 24 through a corresponding one of circulators 8, phased array 4(i) essentially space feeds the radiating elements 24 of Ruze lens 10. Each of circulators 8 prevents the transmit power from passing directly into receive horn 12 where it would corrupt the received signal.

With the aid of beam steering elements 44(i), the focus and direction of launch beam 32 can be controlled so as to generate a transmit beam that is directed anywhere within the range of Ruze lens 10. For example, focusing the launch beam on probe A causes Ruze lens 10 to generate a transmit beam (designated BEAM A in FIG. 2) in direction $\alpha_A$. Whereas, changing the focus of the launch beam to probe B moves the transmit beam (designated BEAM B) to direction $\alpha_B$. Although each of radiating elements 24 is associated with a specific transmit beam direction, transmit beams having intermediate directions may be generated by transferring power to two neighboring radiating elements 24 that correspond to beam directions on either side of the desired beam direction. Moreover, electronically scanning launch beam 32 across probes 28 between probe A and probe B causes the transmit beam generated by Ruze lens 10 to also scan from direction $\alpha_A$ to direction $\alpha_B$.

In a radar application, a return echo from a transmit beam will arrive from the same direction in which the transmit beam was sent. The return echo will, therefore, focus on the particular one of radiating elements 24 in Ruze lens 10 corresponding to that beam direction and will produce a received signal. In a two way communication link application, the receive beam will also arrive from the same direction as the transmit beam. In either case, the energy from the received signal is directed via circulators 8 to receive horn 12 which collects the signals from all probes and sends them to receiver 14.

By driving beam launcher 3 with multiple transmit sources 6(i) to 6(T) as shown in FIG. 2, Ruze lens 10 simultaneously produces multiple, independently steerable transmit beams equal in number to the number of transmit sources. In other words, each of transmit sources 6 is electrically coupled into a corresponding one of phased arrays 4 so that it produces its own independent launch beam. Each launch beam, in turn, results in a corresponding transmit beam from Ruze lens 10. If different center frequencies are used for each of the transmit beams, the different received signals collected by receive horn 12 can be separated by any standard frequency filtering process and thus each of the different received signals can be readily separated from the total signal collected by receive horn 12.

Figure 3:
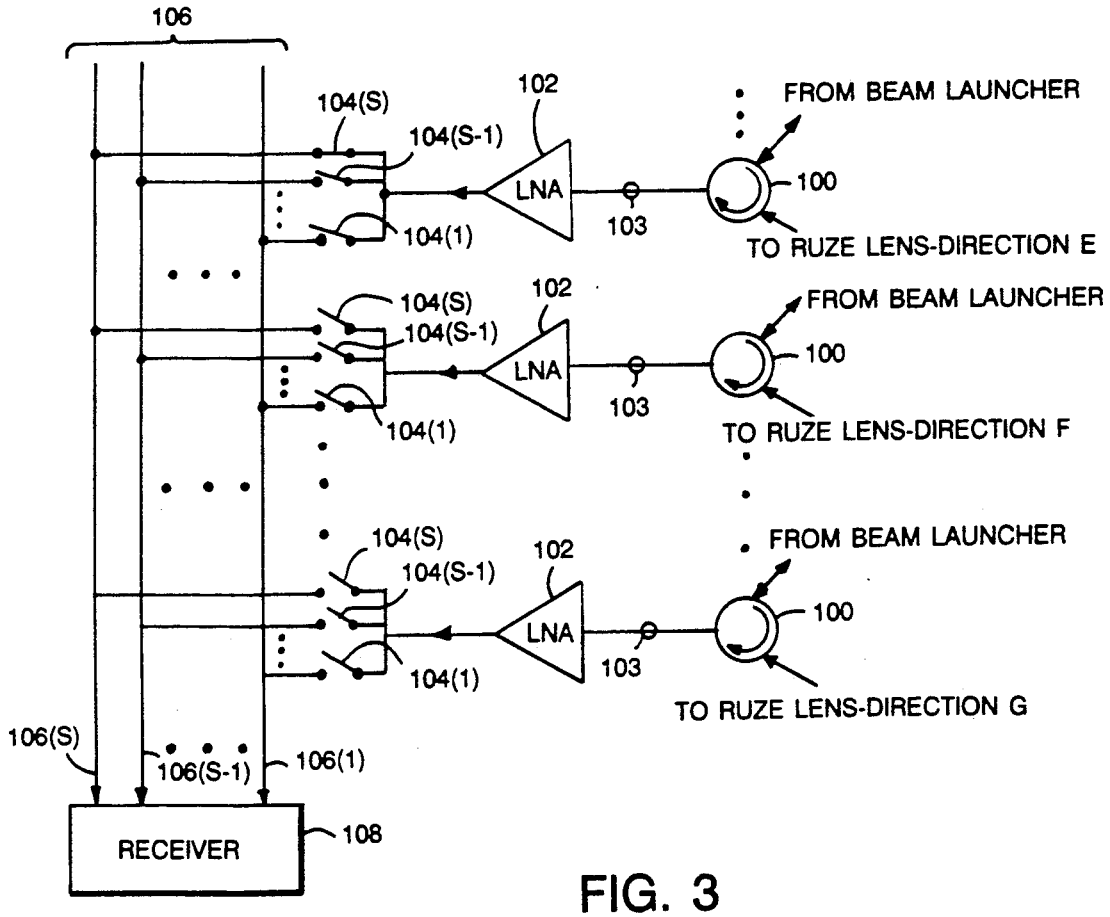
FIG. 3 is a block diagram of a portion of a shared aperture antenna system in which a receive bus is used in place of a receive horn to select received signals.

If transmit sources 6 use the same center frequency, then it may be desirable to use a multiple line signal bus in place of receive horn 12 to select desired received signals corresponding to particular directions. FIG. 3 illustrates the circuitry used to select the received signals associated with a particular receive beam direction. As previously described, each circulator 100 directs transmit power from an associated probe of the beam launcher to a corresponding one of the focal arc radiating elements of the Ruze lens and it directs the received signal from that same radiating element to a corresponding one of an array of internal probes 103. Each of the internal probes 103 has an associated receiver circuit that includes an optional low noise amplifier (LNA) 102 and a matrix of switches 104(1) to 104(S) for connecting the output of LNA 102 to a selected line of a signal bus 106 having S separate signal lines 106(1) to 106(S). Each line of signal bus 106 is connected to a corresponding channel of an S channel receiver 108.

To select the received signals associated with a particular received beam direction, the switch matrices 104 electrically couple the signals coming from the focal arc radiating elements corresponding to that direction onto the desired signal line and isolate all received signals from other radiating elements from that line. Thus, each line of signal bus 106 may be dedicated to receiving signals only from a particular beam direction. Changing the direction from which signals are received is accomplished by simply using the switch matrices 104 to disconnect one set of radiating elements from the line and connect another set of radiating elements corresponding to a new direction to the line. In the configuration shown in FIG. 3, received signals from direction E are being coupled to line 106(S). Changing beam direction from direction E to direction F merely involves opening switch 104(S) corresponding to beam direction E and closing switch 104(S) corresponding to beam direction F.

In the above-described embodiments, power splitters 40 and beam steering elements 44 can be implemented by any standard phased array antenna technique. In addition, the radiating elements 26 of phased arrays 4 can be oriented along a straight line or any curved line or can be randomly deployed in the vicinity of a straight line. Generally, a primary consideration on the positioning of the elements of phased array 26 is that the power impinging on the selected one of probes 28 be maximized and power impinging on all other probes 28 be minimized. Achievement of that condition may be enhanced by tapering of the power level applied to the array radiating elements 26 rather than using the uniform P/M power distribution suggested above.

Figure 4:
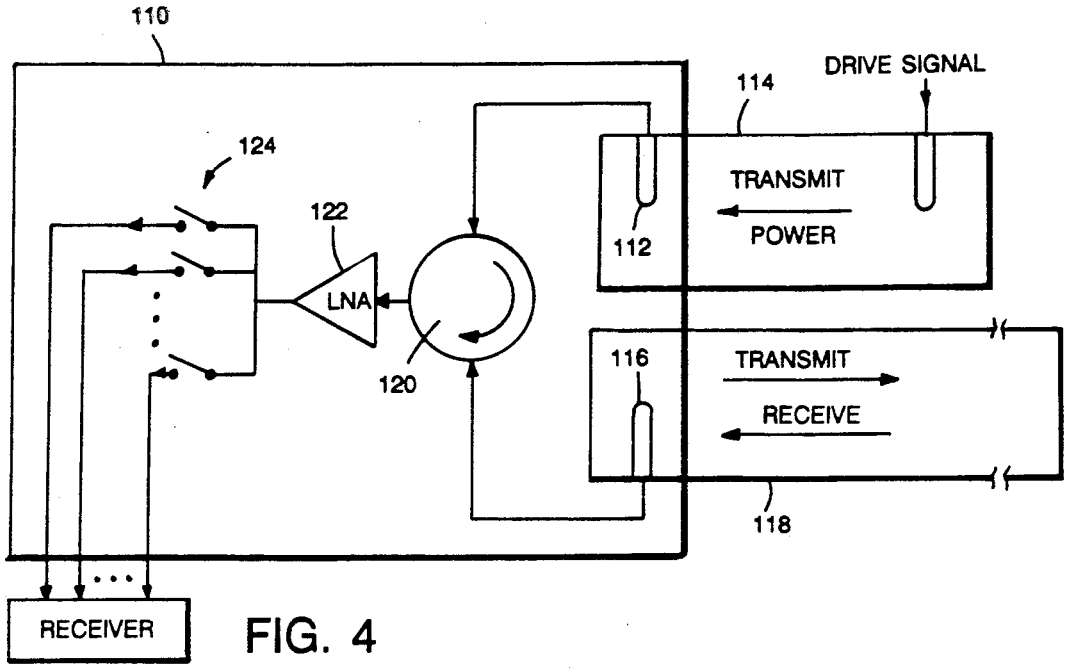
FIG. 4 depicts a microstrip implementation of a portion of the shared aperture antenna system.

As indicated in FIG. 4, a practical implementation of the receiver bus embodiment may consist of microstrip lines on a substrate 110. Each substrate 110 would include a probe 112 of beam launcher 114 and an associated radiating element 116 of Ruze lens 118, both implemented as microstrip lines; an associated circulator 120 and low noise amplifier (LNA) 122, implemented as discrete drop-in type components; and a switch matrix 124.

Other embodiments are within the following claims. For example, although a Ruze lens is described, any lens that accommodates probes on its focal arc may be used.

Figure 5:
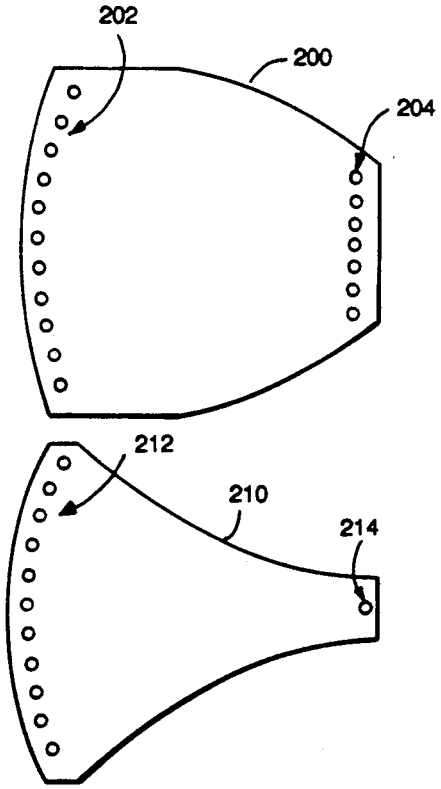
FIG. 5 is an alternative structure for the beam launcher and the receive horn.

In addition, it may be desirable to mount either the beam launcher or the receiver horn or both on the concave side of the focal arc of the Ruze lens, rather than on the convex side as shown in FIG. 2. If both beam launcher 200 and receive horn 210 are positioned on the concave side of the focal arc, their structures are modified as shown in FIG. 5. In beam launcher 200, the focal arc radiating probes 202 are arrayed along a curve having radius R, as before, but the phased array radiating elements 204 are positioned on the concave side of the array of radiating probes 202. Similarly, in receive horn 210, the internal probes 212 are arrayed along a curve of radius R and the receive probe 214 is positioned on the concave side of the array of internal probes 212.

Figure 6:
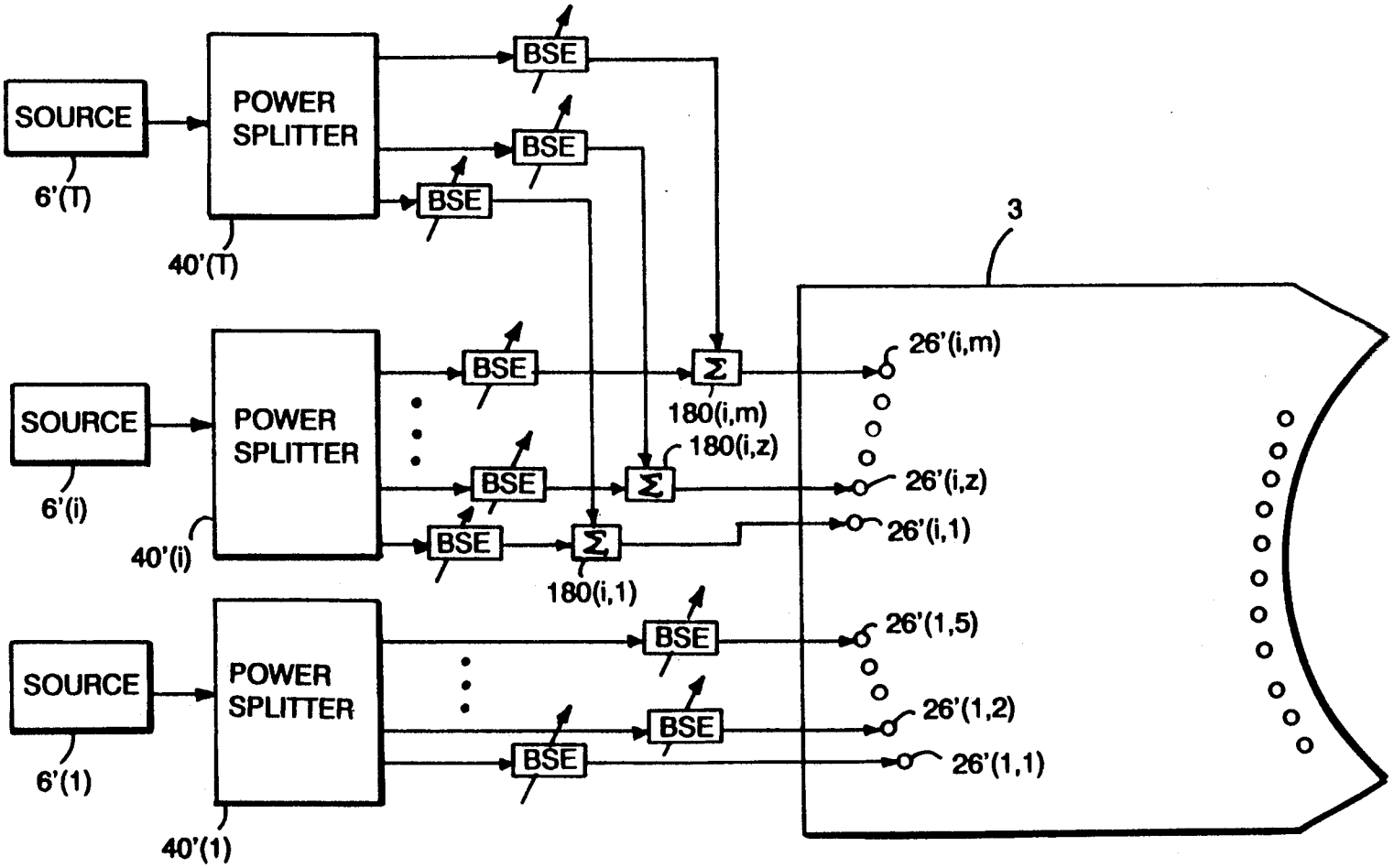
FIG. 6 is another alternative embodiment.

FIG. 2 depicts each phased array as having a dedicated set of array radiating elements and that the number of radiating elements may vary from one array to another. That is, phased array 4(1) has S radiating elements, phased array 4(i) has M radiating elements and phased array 4(T) has P radiating elements. It may be desirable for some of the sources 6' to share a set of radiating elements as shown in FIG. 6. As illustrated, sources 6'(i) and 6'(T) share phased array radiating elements 26'(i) through the use of summing circuits 180(1) to 180(M). In some applications, a group of sources may share one set of phased array radiating elements and other sources may use another set of radiating elements.

In a less complex embodiment, the shared aperture antenna services only one source and produces only one transmit/receive beam. This capability is comparable to a line source of length $L_o$ and containing approximately $2L_o/\lambda$ radiating elements and associated beam steering elements.

The line sources described above steer in only one dimension such as azimuth. Combined azimuth and elevation steering can be achieved by stacking of multiple Ruze lenses wherein each Ruze lens in the stack has a full complement of beam launchers and receivers and elevation steering is provided by an array of beam steering elements placed between the source or receiver and the units in the stack.

What is claimed is:

1. An antenna comprising:

a lens comprising an array of radiating elements located on a focal arc, each radiating element corresponding to a different transmission beam direction; and a beam launcher comprising a plurality of phased arrays and a plurality of internal probes, each of said plurality of internal probes being electrically coupled to a corresponding one of said radiating elements, each of the phased arrays of said plurality of phased arrays being independently steered and having a corresponding aperture that is internal to the beam launcher wherein each phased array selectively space feeds a corresponding one or more of said internal probes with a different transmit signal through its corresponding aperture so as to generate a plurality of independently steered transmission beam patterns from said lens, the aperture of at least one of said plurality of phased arrays being separate from the apertures of the other of said plurality of phased arrays.

2. The antenna of claim 1 wherein the lens comprises means for limiting orthogonal dispersion of the transmit beam.

3. The antenna of claim 2 wherein the dispersion limiting means comprises two parallel metal plates, said array of radiating elements being located between said metal plates.

4. The antenna of claim 1 wherein the lens is a Ruze lens.

5. The antenna of claim 1 wherein the lens is a Rotman lens.

6. The antenna of claim 1 wherein the focal arc is a circular arc.

7. The antenna of claim 6 wherein the internal probes are arrayed along a curve having a radius R.

8. The antenna of claim 1 wherein at least one of said plurality of phased arrays is a focused phased array comprising a plurality of phased array radiating probes.

9. The antenna of claim 8 wherein the beam launcher further comprises two parallel metal plates, said phased array radiating probes an said plurality of internal probes being located between said metal plates.

10. The antenna of claim 1 further comprising a receiver circuit for receiving received signals from at least some of said lens radiating elements.

11. The antenna of claim 10 wherein the receiver circuit comprises a receiver horn.

12. The antenna of claim 11 wherein the receiver horn comprises a flared waveguide having a narrow end and a wide end opposed to the narrow end, the receiver horn further comprising an array of internal probes located at the wide end and a receive probe located at the narrow end.

13. The antenna of claim 12 wherein the array of internal probes in said horn is arrayed along a curve having a radius R.

14. The antenna of claim 10 wherein the receiver circuit comprises a signal bus and a matrix of switches for electrically coupling selected elements of the array of radiating elements to said signal bus.

15. The antenna of claim 10 further comprising a plurality of circulators for directing transmission energy from the plurality of internal probes to the array of radiating elements and for directing received energy from the array of radiating elements to the receiver circuit.

16. The antenna of claim 1 further comprising a plurality of transmitters, each of said transmitters coupled to and driving a different one of said plurality of phased arrays with a different transmit signal.

17. An antenna comprising:

a primary lens comprising an array of radiating elements located on a focal arc, each radiating element corresponding to a different transmission beam direction;

a beam launcher comprising a plurality of phased arrays and a plurality of internal probes, each of said plurality of internal probes being electrically coupled to a corresponding one of said radiating elements, each of the phased arrays of said plurality of phased arrays being independently steered and selectively space feeding a corresponding one or more of said internal probes with a different transmit signal so as to generate a plurality of independently steered transmission beam patterns from said primary lens; and a receiver circuit for receiving received signals from at least some of said array of radiating elements, said receiver circuit comprising a receiver lens electrically coupled to said array of radiating elements, said receiver circuit being separate and distinct from said beam launcher.

18. The antenna of claim 17 wherein the primary lens comprises means for limiting orthogonal dispersion of the transmit beam.

19. The antenna of claim 18 wherein the dispersion limiting means comprises two parallel metal plates, said array of radiating elements being located between said metal plates.

20. The antenna of claim 17 wherein the primary lens is a Ruze lens.

21. The antenna of claim 17 wherein the primary lens is a Rotman lens.

22. The antenna of claim 17 wherein the focal arc is a circular arc.

23. The antenna of claim 22 wherein the internal probes are arrayed along curve having a radius R.

24. The antenna of claim 17 wherein at least one of said plurality of phased arrays is a focused phased array comprising a plurality of phased array radiating probes.

25. The antenna of claim 24 wherein the beam launcher further comprises two parallel metal plates, said phased array radiating probes and said plurality of internal probes being located between said metal plates.

26. The antenna of claim 17 wherein the receiver lens comprises a horn.

27. The antenna of claim 26 wherein the horn comprises a flared waveguide having a narrow end and a large end opposed to the narrow end, the horn further comprising an array of internal probes located at the wide end and a receive probe located at the narrow end.

28. The antenna of claim 27 wherein the array of internal probes in said horn is arrayed along a curve having a radius of R.

29. The antenna of claim 17 wherein the receiver circuit comprises a signal bus and a matrix of switches for electrically coupling selected elements of the array of lens radiating elements to said signal bus.

30. The antenna of claim 17 further comprising a plurality of circulators for directing transmission energy from the plurality of internal probes to the array of radiating elements and for directing received energy from the array of radiating elements to the receiver lens.

31. An antenna comprising:

a lens comprising an array of radiating elements located on a focal arc, each radiating element corresponding to a different transmission beam direction; and a beam launcher comprising at least a first and a second phased array and a plurality of internal probes, each of said plurality of internal probes being electrically coupled to a corresponding one of said radiating elements, said first phased array for selectively space feeding one or more of said internal probes with a first signal so as to generate a corresponding first transmission beam pattern from said lens, said second phased array for selectively space feeding one or more of said internal probes with a second signal so as to generate a corresponding second transmission beam pattern from said lens, wherein said first and second phased arrays are independently steered and said first and second transmission beam patterns are independently steered and wherein said first and second signals have the same carrier frequency.

32. The antenna of claim 31 wherein the lens comprises means for limiting orthogonal dispersion of the transmit beam.

33. The antenna of claim 32 wherein the dispersion limiting means comprises two parallel metal plates, said array of radiating elements being located between said metal plates.

34. The antenna of claim 31 wherein the lens is a Ruze lens.

35. The antenna of claim 31 wherein the lens is a Rotman lens.

36. The antenna of claim 31 wherein at least one of the first and second phased arrays is a focused phased array comprising a plurality of phased array radiating probes.

37. The antenna of claim 36 wherein the beam launcher further comprises two parallel metal plates, said phased array radiating probes and said array of internal probes being located between said metal plates.

* * * * *

UNITED STATES PATENT AND TRADEMARK OFFICE

CERTIFICATE OF CORRECTION

PATENT NO. : 5,128,687

DATED : July 7, 1992

INVENTOR(S) : Francis A. Fay

It is certified that error appears in the above-indentified patent and that said Letters Patent is hereby corrected as shown below:

ON THE TITLE PAGE, ITEM 56:

References Cited (U.S. PATENT DOCUMENTS)

4,490,723: "12/1985" should be --12/1984--.

References Cited (OTHER PUBLICATIONS)

"John Ruze, "Wide-Angle Metal-Plate Optics", vol. 1 Proceedings of the I.R.E. vol. 38 pp. 53-59, (Jan. 1950)." should read
--John Ruze, "Wide-Angle Metal-Plate Optics", Proceedings of the I.R.E. vol. 38, no. 1, pp. 53-59, (Jan. 1950).--

UNITED STATES PATENT AND TRADEMARK OFFICE

CERTIFICATE OF CORRECTION

PATENT NO. : 5,128,687

DATED : July 7, 1992

INVENTOR(S) : Francis A. Fay

It is certified that error appears in the above-identified patent and that said Letters Patent is hereby corrected as shown below:

Column 3, line 39, delete "are" after "which".
Column 4, line 53, "Lo" should read --$L_o$--.
Column 6, line 26, "6(i)" should read --6(1)--.

Claims
Column 8, line 53, claim 9, "an" should read --and--.
Column 9, line 54, claim 23, insert --a-- before "curve".
Column 10, line 5, claim 27, "large" should read --wide--.
Column 10, line 10, claim 28, delete "of" after "radius".
Column 10, line 14, claim 29, delete "lens" before "radiating".

Signed and Sealed this

Twenty-first Day of December, 1993

*Attest:*

*Attesting Officer*

BRUCE LEHMAN

*Commissioner of Patents and Trademarks*